US006327959B1

(12) United States Patent
Takahashi et al.

(10) Patent No.: US 6,327,959 B1
(45) Date of Patent: Dec. 11, 2001

(54) DIRECTIONAL CONTROL VALVE DEVICE

(75) Inventors: Kinya Takahashi; Yoshizumi Nishimura, both of Tsuchiura; Yusaku Nozawa, Ibaraki-ken; Nobuhiko Ichiki, Ibaraki-ken; Mitsuhisa Tougasaki, Ibaraki-ken, all of (JP)

(73) Assignee: Hitachi Construction Machinery, Tokyo (JP)

( * ) Notice: Subject to any disclaimer, the term of this patent is extended or adjusted under 35 U.S.C. 154(b) by 0 days.

(21) Appl. No.: 09/600,318

(22) PCT Filed: Jan. 12, 1999

(86) PCT No.: PCT/JP99/06722

§ 371 Date: Jul. 13, 2000

§ 102(e) Date: Jul. 13, 2000

(87) PCT Pub. No.: WO00/32943

PCT Pub. Date: Jun. 8, 2000

(30) Foreign Application Priority Data

Dec. 2, 1998 (JP) ..... 10-343072

(51) Int. Cl.[7] ..... F15B 11/08
(52) U.S. Cl. ..... 91/436; 137/625.68
(58) Field of Search ..... 91/28, 29, 31, 91/436; 137/625.68

(56) References Cited

U.S. PATENT DOCUMENTS 4,434,708 * 3/1984 Bowden ..... 91/436

FOREIGN PATENT DOCUMENTS 58-163802 9/1983 (JP) .
6-25602 4/1994 (JP) .
7-17841 4/1995 (JP) .
8-35502 2/1996 (JP) .

* cited by examiner

*Primary Examiner*—Edward K. Look
*Assistant Examiner*—Thomas E. Lazo
(74) *Attorney, Agent, or Firm*—Mattingly, Stanger & Malur, P.C.

(57) ABSTRACT

A recovery check valve 26 and a piston valve 27 are axially slidably disposed within a spool 2 in coaxial relation. An axial fluid passage 32 is formed within a cylindrical portion 27*a* of the piston valve 27, and a seat portion 33 for the recovery check valve is formed at an open end of the cylindrical portion 27*a*. The cylindrical portion 37*a* of the piston valve is formed with a hole 36 through which a hydraulic fluid in the fluid chamber 32 is introduced to a bridge passage 21 when the spool 2 is operated so as to introduce a hydraulic fluid from a hydraulic pump to the bottom side of a hydraulic cylinder. Fluid passages 40, 31 are formed within the spool so that a hydraulic fluid in the bridge passage 21 is introduced to the closed end of the piston valve through the fluid passages when the spool is operated in the opposite direction. With such a structure, the size of the valve apparatus can be set to the same size as the directional control valve not provided with the recovery check valve.

3 Claims, 6 Drawing Sheets

DIRECTIONAL CONTROL VALVE DEVICE

TECHNICAL FIELD

The present invention relates to a directional control valve apparatus for use in a hydraulic drive system of construction machines, and more particularly to a directional control valve apparatus wherein a spool incorporates therein a recovery check valve for recovering a flow of a hydraulic fluid to an arm cylinder of a hydraulic excavator, for example.

BACKGROUND ART

As a directional control valve apparatus including a recovery check valve which recovers a flow of a hydraulic fluid to a hydraulic actuator, there is known one wherein a spool incorporates therein a recovery check valve for simplification of the apparatus, as disclosed in JP,Y 7-17841, for example.

DISCLOSURE OF THE INVENTION

In the directional control valve apparatus shown in FIG. 1, etc. of JP,Y 7-17841, the side including a recovery check valve is illustrated as having substantially the same length as the side not including a recovery check valve. In actual design, however, it has been found that when a recovery check valve is incorporated in a spool in accordance with the same concept as the technique of JP,Y 7-17841, the side including a recovery check valve is longer than the side not including a recovery check valve. This point will be described with reference to FIGS. 4 to 6.

FIGS. 4 to 6 show a directional control valve apparatus that is designed In accordance with the same concept as the technique disclosed in JP,Y 7-17841.

In FIGS. 4 to 6, the illustrated directional control valve apparatus comprises a casing 101, a spool 102 axially slidably disposed in a spool bore of the casing, and a load check valve 103. In the spool bore of the casing 101, there are formed two reservoir ports 104, 105, two actuator ports 106, 107, two communicating ports 111, 112, and three center bypass ports 108, 109, 110 in the order named from both outer axial ends. Further, a bridge passage 121 for interconnecting the two communicating ports 111, 112, a center bypass passage 123 for connecting a hydraulic pump 122 to the middle one 110 of the three center bypass ports 108, 109, 110, and a center bypass passage 124 for interconnecting the other two center bypass ports 108, 109 and connecting them to a reservoir 125 are formed. In addition, a recovery check valve 126 is axially slidably disposed within the spool 102 such that, when the spool 102 is operated so as to introduce a hydraulic fluid from the hydraulic pump 122 to the bottom side of a hydraulic cylinder 150, the fluid returned from the rod side of the hydraulic cylinder 150 is recovered to the bridge passage 121.

The operation of the directional control valve apparatus will be described below.

(1) Neutral (FIG. 4)

The hydraulic fluid delivered from the hydraulic pump 122 is introduced to the directional control valve apparatus. However, because the spool 102 is not operated, the hydraulic fluid is introduced to the reservoir 125 through the center bypass passages 123, 124. Also, the holding pressure of the hydraulic cylinder 150 is in a closed condition by lands 113 and 114.

(2) Extension of Hydraulic Cylinder: Recovery (FIG. 5)

When the spool 102 is moved to the left in the drawing to extend the hydraulic cylinder 150, the communication between the center bypass passages 123, 124 is closed by lands 116 and 117. Also, with the leftward movement of the spool 102 in the drawing, the communicating port 112 and the actuator port 107 are communicated with each other, whereupon the hydraulic fluid delivered from the hydraulic pump 122 is introduced to the bottom side of the hydraulic cylinder 150 via the load check valve 103, the bridge passage 121, the communicating port 112 and the actuator port 107. On the other hand, the hydraulic fluid returned from the rod side of the hydraulic cylinder 150 is drained to the reservoir 125 via the actuator port 106 and the reservoir port 104 which are also communicated with each other upon the leftward movement of the spool 102 in the drawing. At the same time, a hole 129 on the input side of the recovery check valve 126 is opened to the actuator port 106, and a hole 130 on the output side of the recovery check valve 126 is communicated with the bridge passage 121 through the communicating port 111. In the operation wherein the hydraulic cylinder 150 is extended under its own load W, a pressure of the hydraulic fluid pushed out of the rod side of the hydraulic cylinder 150 is higher than that of the hydraulic fluid supplied to the bottom side of the hydraulic cylinder 150. Therefore, most of the hydraulic fluid pushed out of the rod side of the hydraulic cylinder 150 enters the hole 129 through the actuator port 106 to push open the check valve 126 that is incorporated as a recovery valve in the spool 102, and is recovered to the bridge passage 121 through the hole 130.

(3) Contraction of Hydraulic Cylinder (FIG. 6)

When the spool 102 is moved to the right in the drawing to contract the hydraulic cylinder, the communication between the center bypass passages 123, 124 is closed by the lands 116 and 117. Also, with the rightward movement of the spool 102 in the drawing, the communicating port 111 and the actuator port 106 are communicated with each other, whereupon the hydraulic fluid delivered from the hydraulic pump 122 is introduced to the rod side of the hydraulic cylinder 150 via the load check valve 103, the bridge passage 121, the communicating port 111 and the actuator port 106. At this time, because the hole 130 is closed by the land 115, the hydraulic fluid delivered from the hydraulic pump 122 is prevented from leaking to the reservoir 125. On the other hand, the hydraulic fluid returned from the bottom side of the hydraulic cylinder 150 is drained to the reservoir 125 via the actuator port 107 and the reservoir port 105 which are also communicated with each other upon the rightward movement of the spool 102 in the drawing.

Thus, the directional control valve apparatus shown in FIGS. 4 to 6 can fulfill the recovery function with a simple structure.

In the directional control valve apparatus having the above-described construction, however, when the valve is operated in direction contrary to the recovery, i.e., when the spool 102 is moved to the right in the drawing as shown in FIG. 6, the spool 102 is required to have a lap allowance X1 relative to the lands 115, 118 so that the bridge passage 121 and the center bypass passage 124 are not communicated with each other. The reason is that, if the bridge passage 121 and the center bypass passage 124 are communicated with each other, the hydraulic fluid delivered from the hydraulic pump 122 would push open the recovery check valve 126 via the load check valve 103 and the bridge passage 121, followed by escaping to the center bypass passage 124. On the other hand, when the valve is operated for the recovery, i.e., when the spool 102 is moved to the left in the drawing as shown in FIG. 5, the hole 130 is required to have an opening width X2 relative to the communicating port 111 so that the actuator port 106 and the bridge passage 121 are communicated with each other.

It is here assumed that the left and right communicating ports 111, 112 have the same length Xa and spool portions projecting from the edges of the lands 115, 118 facing the center bypass ports 108, 109 in the neutral state of FIG. 4 have the same length Xb. Comparing a length Xh of the land 115 on the side including the recovery check valve 126 and a length Xm of the land 118 on the side not including the recovery check valve 126, the length Xh of the land 115 on the side including the recovery check valve 126 is required to have a value resulted from subtracting the length Xa of the communicating port 111 from the sum of a rightward stroke X of the spool 102 in the drawing, the lap allowance X1, a leftward stroke X of the spool 102 in the drawing, and the opening width X2, whereas the length Xm of the land 118 on the side not including the recovery check valve 126 is required just to have a value resulted from subtracting the projection length Xb from the sum of the stroke X of the spool 102 and the lap allowance X1. That is to say:

$$Xh=(X+X1)+(X+X2)-Xa$$

$$Xm=X+X1-Xb$$

Further, in actual design, the lands and ports are usually set to have necessary minimum lengths for the purpose of making the overall construction of the directional control valve apparatus as compact as possible. When designing the directional control valve apparatus shown in FIGS. 4 to 6 under such conditions, the land 115 on the side not including the recovery check valve 126 is longer than the land 118 on the side not including the recovery check valve 126 because the lengths Xh, Xm of the lands 115, 118 are defined as described above.

More specifically, let suppose that the spool 102 and the land 115 are cut by a length of Xh−Xm to the left, in the drawing, from the edge position of the land 115 facing the center bypass port 108 to render the length Xh of the land 115 equal to the length Xm of the land 118 while the hole 130 formed in the spool 102 is positioned so as to surely provide the opening width X2 when the spool 102 is moved to the left in the drawing as shown in FIG. 5. In this case, when the spool 102 is moved to the right in the drawing through the stroke X as shown in FIG. 6, the hole 130 is opened to the center bypass port 108, whereby the hydraulic fluid delivered from the hydraulic pump 122 pushes open the recovery check valve 126 and is then escaped to the reservoir 125 through the center bypass port 108. For this reason, the length Xh of the land 115 is required to be longer than the length Xm of the land 118.

Generally, a recovery check valve is provided in a directional control valve for, e.g., a hydraulic cylinder having an area difference. In a directional control valve apparatus wherein a directional control valve not including a recovery check valve for a motor or the like and a directional control valve including a recovery check valve for a hydraulic cylinder or the like are mixed as encountered in a hydraulic excavator, the overall size of the valve apparatus must be set in match with the size of the directional control valve including the recovery check valve. This means that the size of the valve apparatus is increased.

An object of the present invention is to provide a directional control valve apparatus in which, even in one having a directional control valve not including a recovery check valve and a directional control valve including a recovery check valve in mixed fashion, the size of the valve apparatus can be set to the same as that of the directional control valve not including the recovery check valve.

(1) To achieve the above object, the present invention provides a directional control valve apparatus comprising a casing, a spool axially slidably disposed in a spool bore of the casing, and a load check valve, the spool bore of the casing being formed with two reservoir ports, two actuator ports, two communicating ports and three center bypass ports in the order named from both outer axial ends toward the center, the casing being formed with a bridge passage connected to a hydraulic pump through the load check valve and interconnecting the two communicating ports, a center bypass passage for connecting the hydraulic pump to the middle port of the three center bypass ports, and a center bypass passage for interconnecting the other two center bypass ports and connecting these two center bypass ports to a reservoir, the spool having a recovery input passage and a recovery output passage both formed therein, the spool including a recovery check valve axially slidably disposed within the spool between the recovery input passage and the recovery output passage, the valve apparatus operating such that when the spool is operated in one direction, the recovery check valve is opened to communicate the recovery input passage and the recovery output passage with each other for recovering a hydraulic fluid returned through the meter-out-side port of the two actuator ports to the bridge passage via the recovery input passage, the recovery check valve, the recovery output passage and the communicating passage on the same side as the meter-out-side actuator port, wherein piston valve means is provided within the spool for closing the recovery output passage when the spool is operated in a direction opposite to the one direction.

With the feature of the piston valve means being provided within the spool, in spite of that the length of a land on the side including the recovery check valve is set to be equal to the length of a land on the side not including the recovery check valve, when the spool is operated in the direction opposite to the one direction, the recovery output passage is closed by the piston valve means. Therefore, the hydraulic fluid delivered from the hydraulic pump is avoided from escaping to the reservoir through the center bypass port, and the same function as conventional one can be provided.

(2) In the above (1), preferably, the piston valve means comprises a piston valve axially slidably disposed within the spool and being able to open and close the recovery output passage, and a fluid passage formed within the spool and opened to the meter-in-side port of the two communicating ports when the spool is operated in the direction opposite to the one direction, thereby introducing a hydraulic fluid in the bridge passage to the piston valve to bias the piston valve in the closing direction.

With those features, the piston valve means closes the recovery output passage when the spool is operated in the direction opposite to the one direction.

(3) In the above (1), preferably, the piston valve means comprises a piston valve axially slidably disposed within the spool in coaxial relation to the recovery check valve and having a seat portion for the recovery check valve, the seat portion being positioned at one end of the piston valve on the side facing the recovery check valve, and a fluid passage formed within the spool and introducing a hydraulic fluid in the bridge passage to the piston valve to bias the piston valve toward the recovery check valve when the spool -is operated in the direction opposite to the one direction, the piston valve having a cylindrical portion opened at the side of the seat portion, closed at the opposite side, and including an axial fluid passage formed therein, the cylindrical portion having a hole formed therein to communicate the axial fluid passage with the recovery output passage.

By so constructing the piston valve means, when the spool is operated in the one direction, the seat portion of the piston valve is moved away from the recovery check valve, whereupon the recovery check valve is opened to recover the hydraulic fluid returned through the meter-out-side actuator port to the bridge passage via the recovery input passage, the recovery check valve, the axial passage within the cylindrical portion of the piston valve, the hole in the cylindrical portion, the recovery output passage, and the communicating passage on the same side as the meter-out-side actuator port. On the other hand, when the spool is operated in the direction opposite to the one direction, the hydraulic fluid in the bridge passage, i.e., the pump pressure, is introduced to the piston valve through the oil passage within the spool, whereupon the piston valve is pushed toward the recovery check valve and the seat portion of the piston valve closes the recovery check valve. The recovery output passage is thus closed.

BEST MODE FOR CARRYING OUT THE INVENTION

A directional control valve apparatus provided with a recovery check valve according to an embodiment of the present invention will be described below with reference to FIGS. 1 to 3.

Figure 1:
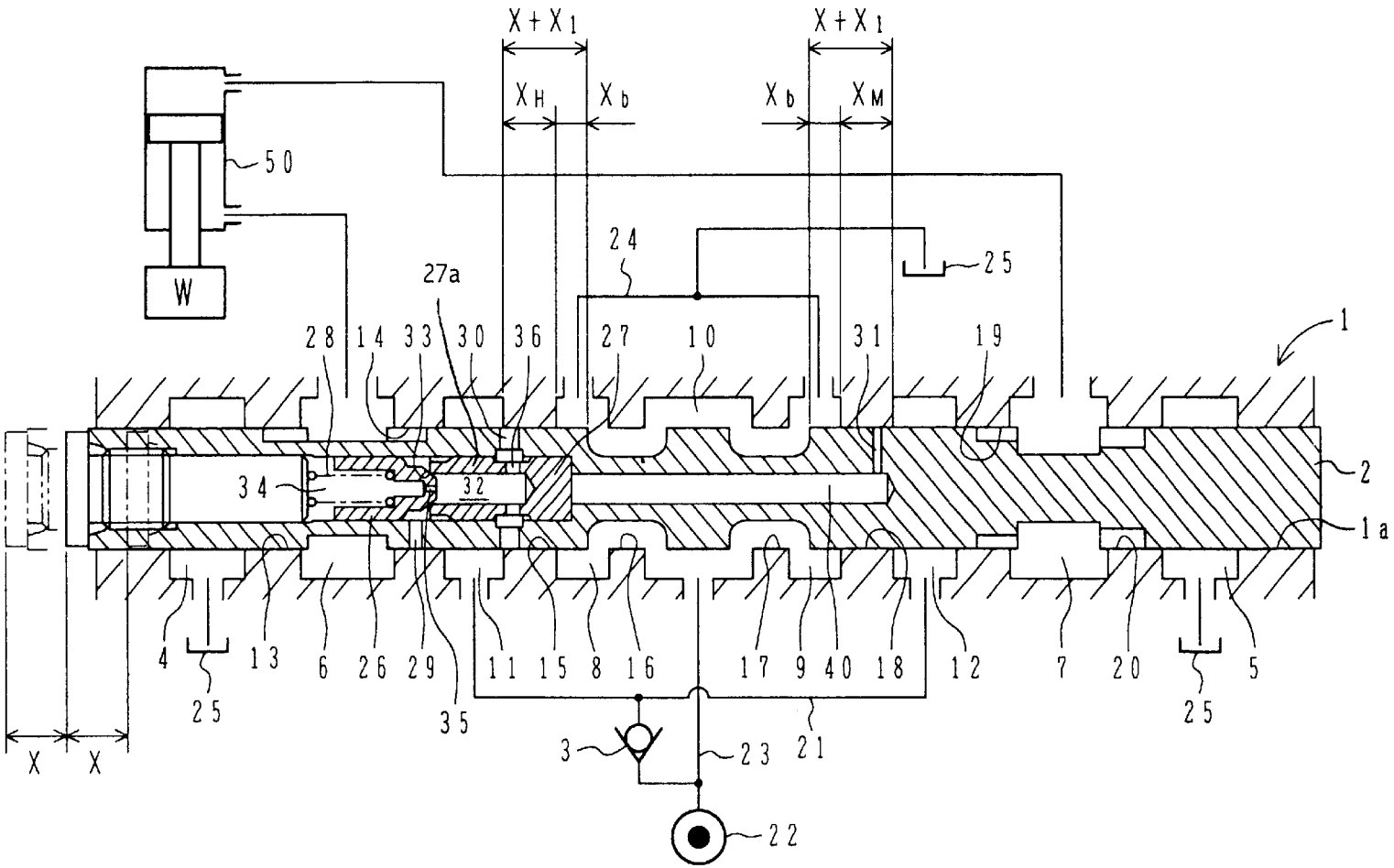
FIG. 1 shows a directional control valve apparatus provided with a recovery check valve according to one embodiment of the present invention with a spool being in a neutral state.
Figure 2:
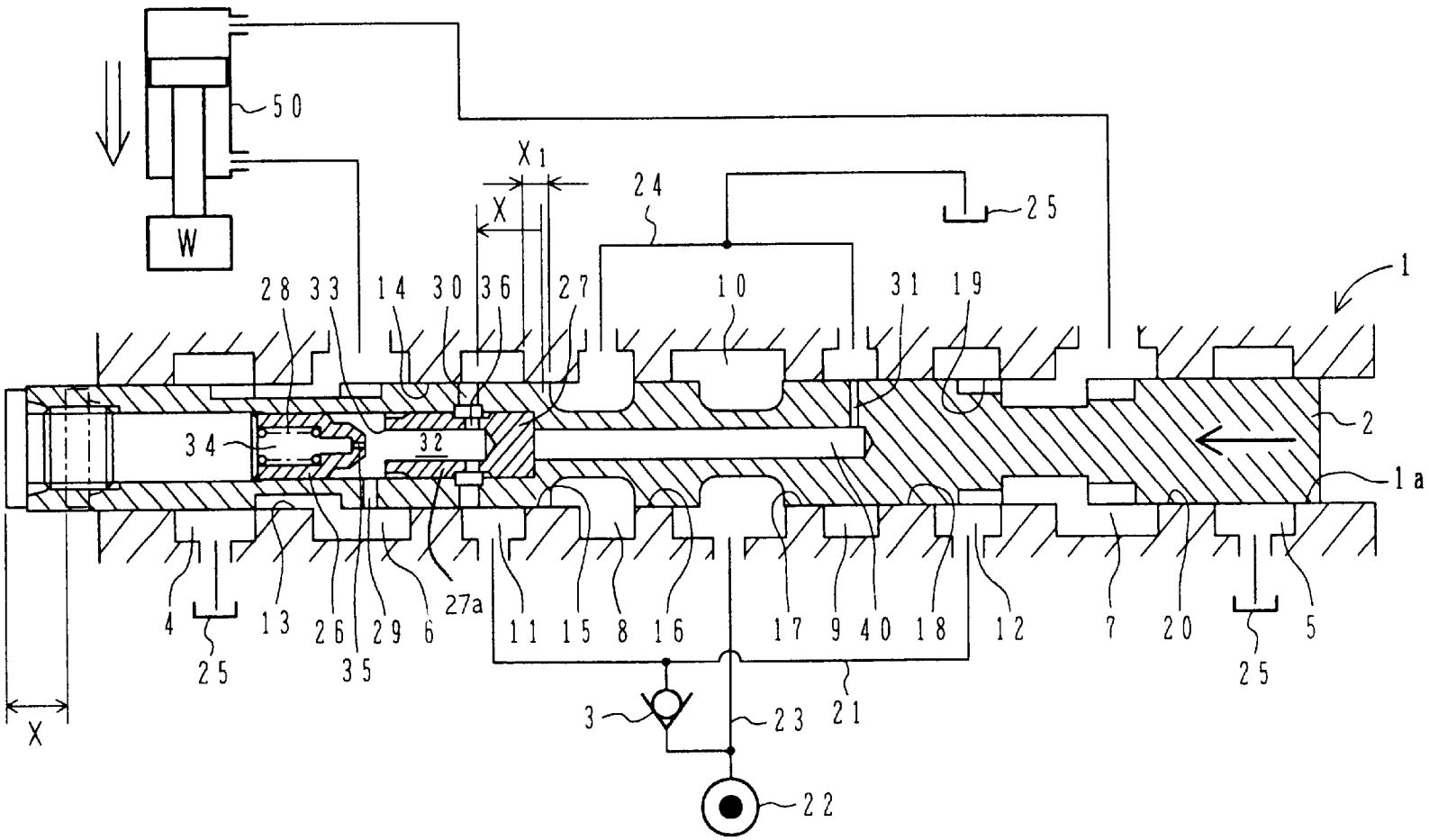
FIG. 2 shows a state in which the spool of the directional control valve apparatus shown in FIG. 1 is moved to the left in the drawing.
Figure 3:
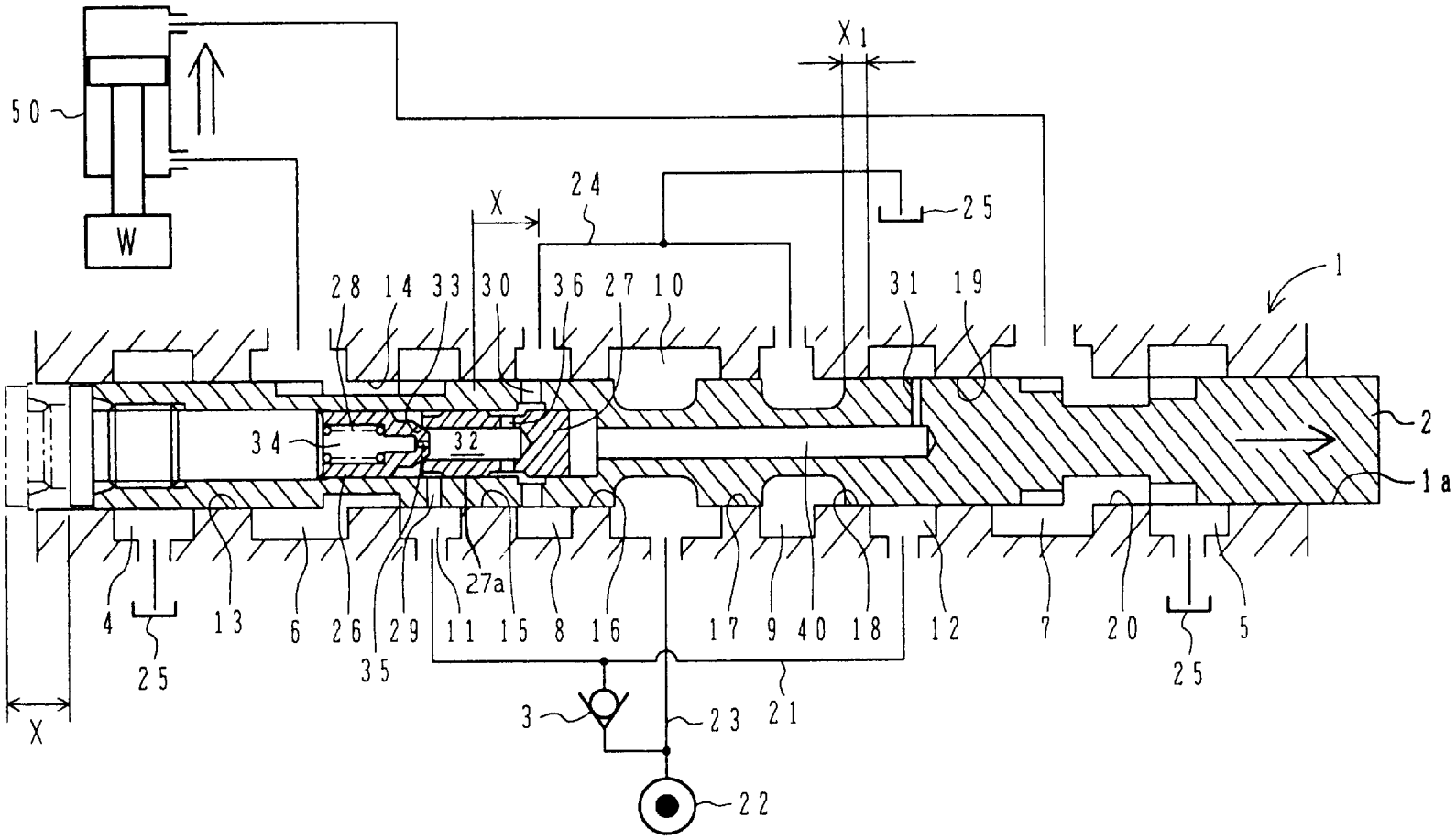
FIG. 3 shows a state in which the spool of the directional control valve apparatus shown in FIG. 1 is moved to the right in the drawing.

FIG. 1 shows a neutral state of the directional control valve apparatus of this embodiment, FIG. 2 shows a state in which a spool is moved to the left in the drawing (i.e., a state in which the spool is operated so as to introduce a hydraulic fluid from a hydraulic pump to the bottom side of a hydraulic cylinder), and FIG. 3 shows a state in which the spool is moved to the right in the drawing (i.e., a state in which the spool is operated so as to introduce the hydraulic fluid from the hydraulic pump to the bottom side of the hydraulic cylinder).

Referring to FIGS. 1 to 3, the directional control valve apparatus comprises a casing 1, a spool 2 axially slidably disposed in a spool bore 1*a* of the casing 1, and a load check valve 3. In the spool bore 1*a* of the casing 1, there are formed two reservoir ports 4, 5, two actuator ports 6, 7, two communicating ports 11, 12, and three center bypass ports 8, 9, 10 in the order named from both outer axial ends toward the center. These ports are separated from each other by lands 13, 14, 15, 16, 17, 18, 19, 20. In the casing 1, a bridge passage 121 and center bypass passages 23, 24 are formed. The communicating port 11 and the communicating port 12 are interconnected by the bridge passage 21. A hydraulic pump 22 is connected to the middle one 10 of the three center bypass ports 8, 9, 10 through the center bypass passage 23. The other two center bypass ports 8, 9 are interconnected by the center bypass passage 24 and then connected to a reservoir 25.

A recovery check valve 26 and a piston valve 27 are axially slidably disposed within the spool 2, and at a left end of the recovery check valve 26 in the drawing, a spring 28 is provided to locate in a spring chamber 34 formed in the recovery check valve 26 and to bias the recovery check valve 26 in the closing direction. Further, in the spool 2, there are formed a hole 29 which is closed by a land 14 when the spool 2 is in a neutral state (FIG. 1), opened to the actuator port 6 when the spool 2 is moved to the left in the drawing (FIG. 2), and opened to the communicating port 11 when the spool 2 is moved to the right in the drawing (FIG. 3); a hole 30 which is opened to the communicating port 11 when the spool 2 is in the neutral state (FIG. 1) and is moved to the left in the drawing (FIG. 2), and opened to the center bypass port 18 when the spool 2 is moved to the right in the drawing (FIG. 3); and a hole 31 which is closed by a land 18 when the spool 2 is in the neutral state (FIG. 1), opened to the center bypass port 9 when the spool 2 is moved to the left in the drawing (FIG. 2), and opened to the communicating port 12 when the spool 2 is moved to the right in the drawing (FIG. 3). The hole 29 functions as a recovery input passage, and the hole 20 functions as a recovery output passage.

The piston valve 27 comprises a cylindrical portion 27*a* which is opened at one side facing the recovery check valve 26, is closed at the opposite side, and has a fluid passage 32 formed therein to extend in the axial direction, and a seat portion 33 for the recovery check valve 26, the seat portion 33 being disposed at an open end of the fluid passage 32 in the cylindrical portion 27*a*, i.e., at a left end thereof in the drawing. Also, the fluid passage 32 and the spring chamber 34 of the recovery check valve 26 are interconnected through a small hole 35 formed in the recovery check valve 26, and the fluid passage 32 of the piston valve 27 and the hole 30 formed in the spool 2 are interconnected through a hole 36 formed in the cylindrical portion 27*a* of the piston valve 27, allowing the hydraulic fluid in the fluid passage 32 to be introduced to the bridge passage 21 when the spool 2 is moved to the left in the drawing (FIG. 2).

Further, a fluid passage 40 extending in the axial direction and communicating with the hole 31 is formed in the spool 2 and opened to face a closed end of the piston valve 27 on the right side in the drawing, allowing the pressure (pump pressure) of the hydraulic fluid in the bridge passage 21 to be introduced through the fluid passage 40 when the spool 2 is moved to the right in the drawing (FIG. 3).

Figure 4:
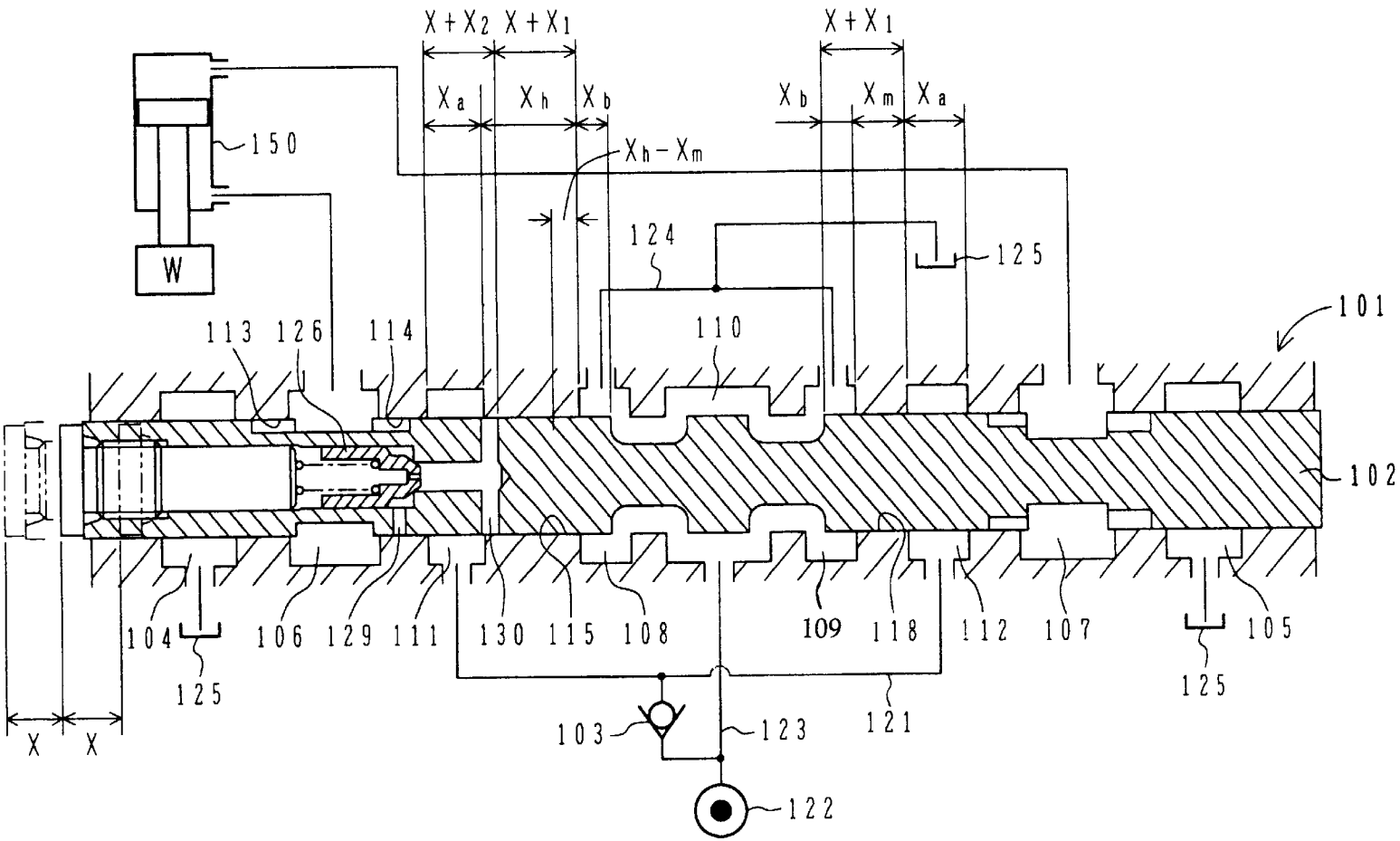
FIG. 4 shows a directional control valve apparatus provided with a recovery check valve, which is designed according to the concept of prior art, with a spool being in a neutral state.
Figure 5:
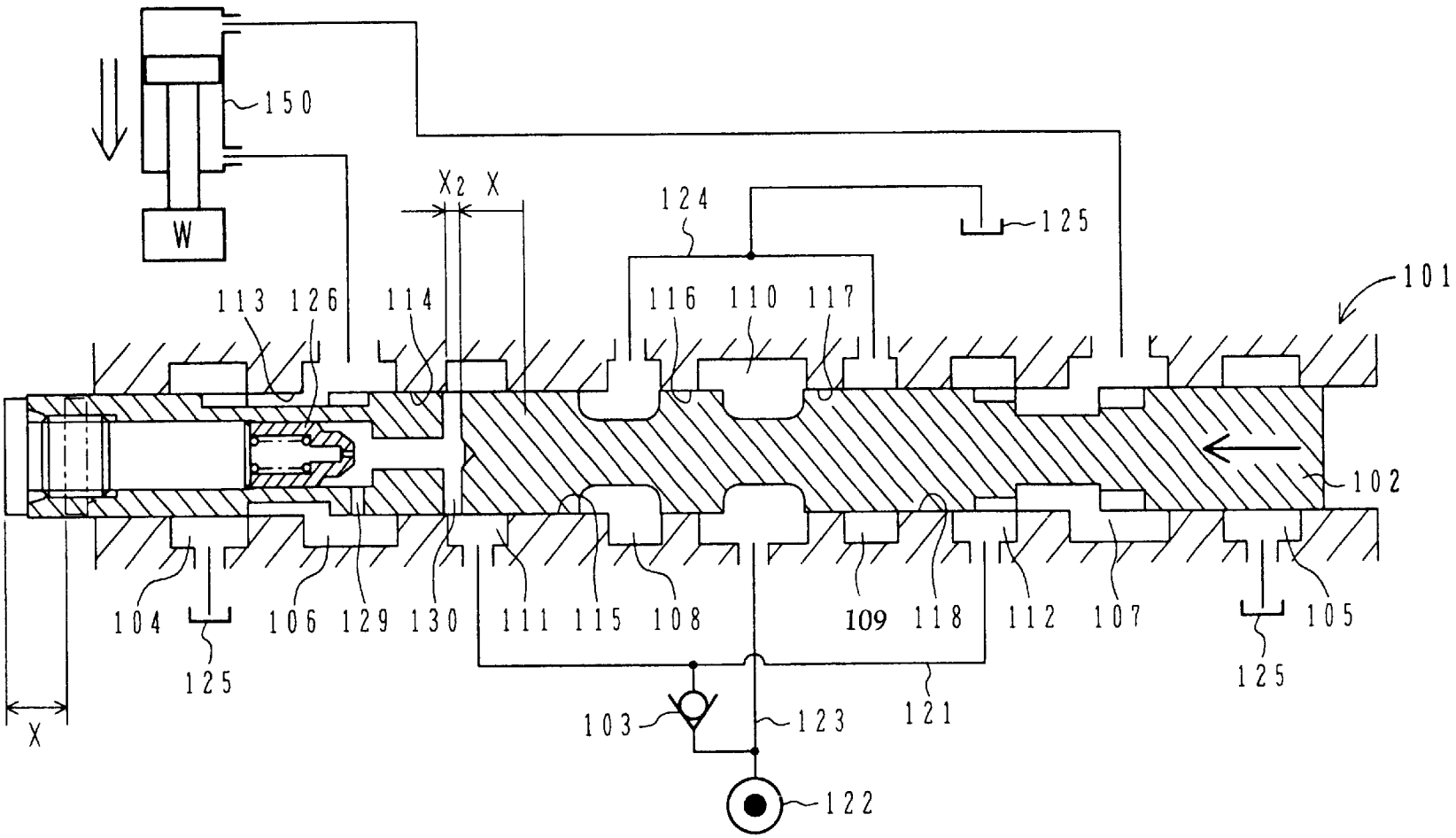
FIG. 5 shows a state in which the spool of the directional control valve apparatus shown in FIG. 4 is moved to the left in the drawing.
Figure 6:
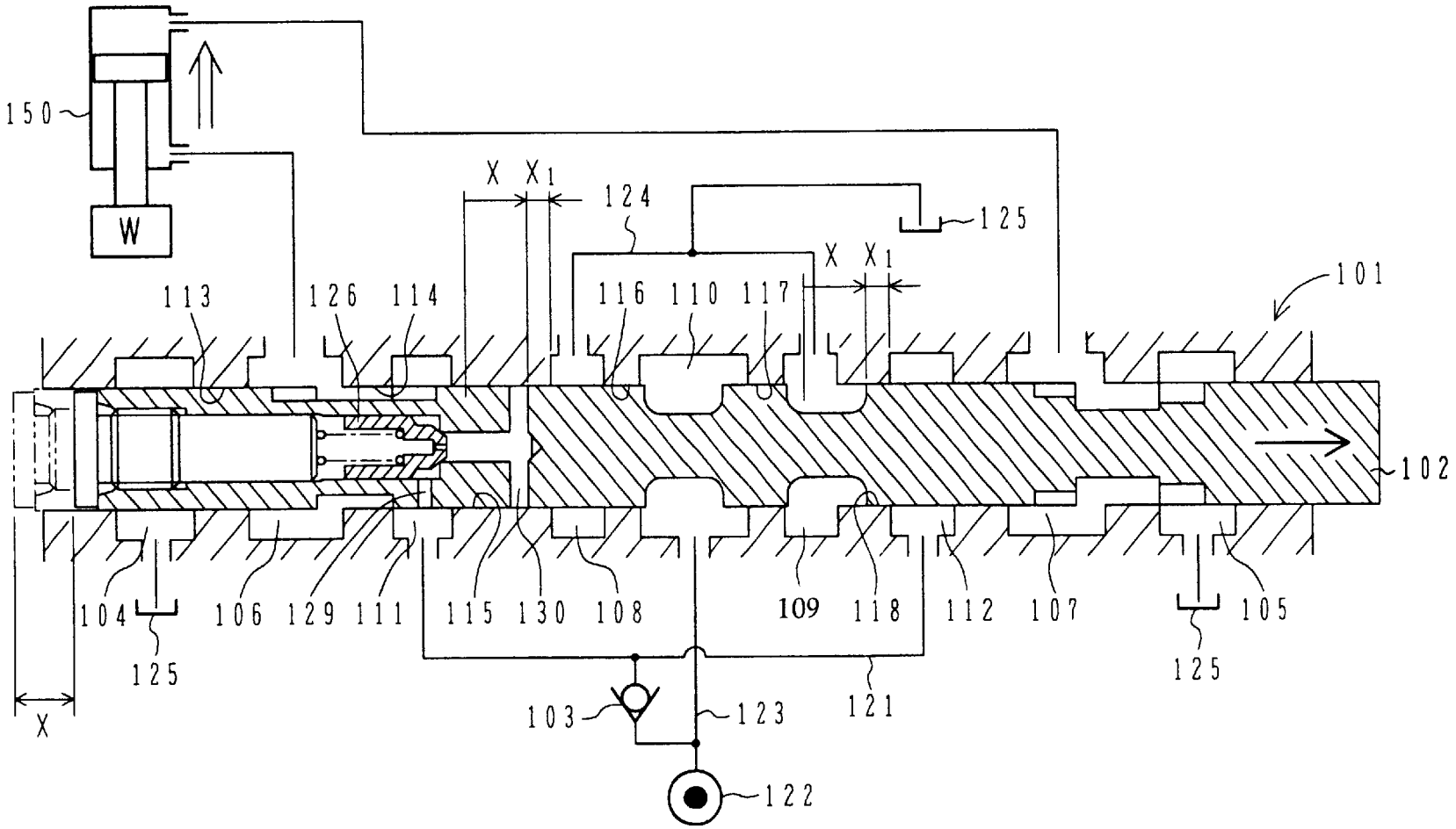
FIG. 6 shows a state in which the spool of the directional control valve apparatus shown in FIG. 4 is moved to the right in the drawing.

The land 15 and the land 18 have the same length that is equal to the length of the land 118 of the directional control valve apparatus, shown in FIGS. 4 to 6, not including the recovery check valve.

More specifically, it is here assumed that spool portions projecting from the edges of the lands 15, 18 facing the center bypass ports 18, 19 in the neutral state of FIG. 1 have the same length Xb as those shown in FIGS. 4 to 6, and the spool 2 has the same lap allowance X1 relative to the land 15 in the operative states of FIGS. 2 and 3 as that shown in FIGS. 4 to 6. Comparing a length XH of the land 15 on the side including the recovery check valve 26 and a length XM of the land 18 on the side not including the recovery check valve 26, both the lands have the same length resulted from subtracting the projection length Xb from the sum of a stroke X of the spool 2 and the lap allowance X1. That is to say:

$$XH=XM=X+X1-Xb(=Xm)$$

Moreover, the left and right communicating ports 11, 12 have the same length that is equal to the length of the communicating port 111 of the directional control valve apparatus, shown in FIGS. 4 to 6, not including the recovery check valve.

The operation of the thus-constructed directional control valve apparatus of this embodiment will be described below.

(1) Neutral (FIG. 1)

The hydraulic fluid delivered from the hydraulic pump 22 is introduced to the directional control valve apparatus. However, because the spool 2 is not operated, the hydraulic fluid is introduced to the reservoir 25 via the center bypass passage 23, the center bypass ports 8, 9 and the center bypass passage 24.

Also, the holding pressure of a hydraulic cylinder 50 is in a closed condition by the lands 13 and 14.

(2) Extension of Hydraulic Cylinder: Recovery (FIG. 2)

When the spool 2 is moved to the left in the drawing to extend the hydraulic cylinder 50, the communication between the center bypass ports 8, 10 is closed by the land 16, and the communication between the center bypass ports 9, 10 is closed by the land 17. Also, with the leftward movement of the spool 2 in the drawing, the communicating port 12 and the actuator port 7 are communicated with each other, whereupon the hydraulic fluid delivered from the hydraulic pump 22 is introduced to the bottom side of the hydraulic cylinder 50 via the hold check valve 3, the bridge passage 21, the communicating port 12 and the actuator port 7.

On the other hand, since the actuator port 6 and the reservoir port 4 are also communicated with each other upon the leftward movement of the spool 2 in the drawing, a part of the hydraulic fluid returned from the rod side of the hydraulic cylinder 50 is drained to the reservoir 25 via the actuator port 6 and the reservoir port 4. At the same time, the hole 29 on the input side of the recovery check valve 26 is opened to the actuator port 6, and the fluid passage 32 in the piston valve 27, which serves as a part of an output side passage of the recovery check valve 26, is communicated with the bridge passage 21 via the holes 36, 30 and the communicating port 11. In the operation wherein the hydraulic cylinder 50 is extended under its own load W, a pressure of the hydraulic fluid pushed out of the rod side of the hydraulic cylinder 50 is higher than that of the hydraulic fluid supplied to the bottom side of the hydraulic cylinder 50. Therefore, most of the hydraulic fluid pushed out of the rod side of the hydraulic cylinder 50 enters the hole 29 through the actuator port 6 to push open the recovery check valve 26 that is incorporated in the spool 2, and is recovered to the bridge passage 21 via the fluid passage 32, the holes 36, 30 and the communicating port 11.

(3) Contraction of Hydraulic Cylinder (FIG. 3)

When the spool 2 is moved to the right in the drawing to contract the hydraulic cylinder 50, the communication between the center bypass ports 8, 10 is closed by the land 16 and the communication between the center bypass ports 9, 10 is closed by the land 17. Also, with the rightward movement of the spool 2 in the drawing, the communicating port 11 and the actuator port 6 are communicated with each other, whereupon the hydraulic fluid delivered from the hydraulic pump 22 is introduced to the rod side of the hydraulic cylinder 50 via the load check valve 3, the bridge passage 21, the communicating port 11 and the actuator port 6.

At this time, the hole 29 is opened to the communicating port 11 and the hole 30 is opened to the center bypass port 8. However, because the hole 31 is opened to the communicating port 12, the pump pressure in the bridge passage 21 acts on the closed end of the piston valve 27 on the right side in the drawing, whereby the piston valve 27 and the recovery check valve 26 are pushed to the left in the drawing to hold the seat portion 33 in a closed state.

On the other hand, since the actuator port 7 and the reservoir port 5 are also communicated with each other upon the rightward movement of the spool 2 in the drawing, the hydraulic fluid returned from the bottom side of the hydraulic cylinder 50 is drained to the reservoir 25 via the actuator port 7 and the reservoir port 5.

In the directional control valve apparatus of this embodiment, as described above, the length XH of the land 15 on the side including the recovery check valve is equal to the length XM of the land 18 on the side not including the recovery check valve 26. Despite such a structure, when the directional control valve is operated in direction contrary to the recovery, i.e., when the spool 2 is moved to the right in the drawing as shown in FIG. 3, the hydraulic fluid delivered from the hydraulic pump 22 is avoided from escaping to the reservoir 25 through the center bypass port 8, and the same function as conventional one can be provided.

With this embodiment, therefore, even in a directional control valve apparatus wherein a directional control valve not including a recovery check valve for a motor or the like and a directional control valve including a recovery check valve for a hydraulic cylinder or the like are mixed as encountered in a hydraulic excavator, the overall size of the valve apparatus can be set in match with the size of the directional control valve not including the recovery check valve. Consequently, the valve apparatus can be compacted and the production cost can be cut down.

INDUSTRIAL APPLICABILITY

According to the present invention, in spite of that the length of the land on the side including the recovery check valve is equal to the length of the land on the side not including the recovery check valve, when the directional control valve is operated in direction contrary to the recovery, the hydraulic fluid delivered from the hydraulic pump is avoided from escaping to the reservoir through the center bypass port, and the same function as conventional one can be provided.

Therefore, even in a directional control valve apparatus wherein a directional control valve not including a recovery check valve for a motor or the like and a directional control valve including a recovery check valve for a hydraulic cylinder or the like are mixed as encountered in a hydraulic excavator, the overall size of the valve apparatus can be set in match with the size of the directional control valve not including the recovery check valve. As a result, the valve apparatus can be compacted and the production cost can be cut down.

What is claimed is:

1. A directional control valve apparatus comprising a casing (1), a spool (2) axially slidably disposed in a spool bore (1*a*) of the casing (1), and a load check valve (3), the spool bore of said casing being formed with two reservoir ports (4, 5), two actuator ports (6, 7), two communicating ports (11, 12) and three center bypass ports (8, 9, 10) in the order named from both outer axial ends toward the center, said casing being formed with a bridge passage (21) connected to a hydraulic pump (22) through said load check valve and interconnecting said two communicating ports, a center bypass passage (23) for connecting said hydraulic pump to the middle port (10) of said three center bypass ports, and a center bypass passage (24) for interconnecting the other two center bypass ports (8, 9) and connecting these two center bypass ports to a reservoir (25), said spool having a recovery input passage (29) and a recovery output passage (30) both formed therein, said spool including a recovery check valve (26) axially slidably disposed within said spool between said recovery input passage and said recovery output passage, said valve apparatus operating such that when said spool is operated in one direction, said recovery check valve is opened to communicate said recovery input passage and said recovery output passage with each other for recovering a hydraulic fluid returned through the meter-out-side port (6) of said two actuator ports to said bridge passage (21) via said recovery input passage, said recovery check valve, said recovery output passage and the communicating port (11) on the same side as said meter-out-side actuator port (6), wherein piston valve means (27, 31, 40) is provided within said spool (2) for closing said recovery output passage (30) when said spool is operated in a direction opposite to said one direction.

2. A directional control valve apparatus according to claim 1, wherein said piston valve means comprises:

a piston valve (27) axially slidably disposed within said spool (2) and being able to open and close said recovery output passage (30), and a fluid passage (31, 40) formed within said spool and opened to the meter-in-side port (12) of said two communicating ports (11, 12) when said spool is operated in the direction opposite to said one direction, thereby introducing a hydraulic fluid in said bridge passage (21) to said piston valve to bias said piston valve in the closing direction.

3. A directional control valve apparatus according to claim 1, wherein said piston valve means comprises:

a piston valve (27) axially slidably disposed within said spool (2) in coaxial relation to said recovery check valve (26) and having a seat portion (33) for said recovery check valve, said seat portion being positioned at one end of said piston valve on the side facing said recovery check valve, and a fluid passage (31, 40) formed within said spool and introducing a hydraulic fluid in said bridge passage (21) to said piston valve (27) to bias said piston valve toward said recovery check valve (26) when said spool is operated in the direction opposite to said one direction, said piston valve (27) having a cylindrical portion (27*a*) opened at the side of said seat portion (33), closed at the opposite side, and including an axial fluid passage (32) formed therein, said cylindrical portion having a hole (36) formed therein to communicate said axial fluid passage with said recovery output passage (30).

* * * * *

UNITED STATES PATENT AND TRADEMARK OFFICE

CERTIFICATE OF CORRECTION

PATENT NO. : 6,327,959 B1
DATED : December 11, 2001
INVENTOR(S) : K. Takahashi et al.

It is certified that error appears in the above-identified patent and that said Letters Patent is hereby corrected as shown below:

Title page,
Please correct the PCT filed date as -- [22] Dec. 1, 1999 --.

Signed and Sealed this

Sixteenth Day of April, 2002

*Attest:*

*Attesting Officer*

JAMES E. ROGAN
*Director of the United States Patent and Trademark Office*